United States Patent [19]

Clark

[11] Patent Number: 4,527,611

[45] Date of Patent: Jul. 9, 1985

[54] PERMANENT MOLD CASTING SYSTEMS

[75] Inventor: Antony P. Clark, Oakville, Canada

[73] Assignee: Cast-Tec Ltd., Canada

[21] Appl. No.: 461,691

[22] Filed: Jan. 28, 1983

[30] Foreign Application Priority Data

Jan. 28, 1982 [CA] Canada ..... 395108

[51] Int. Cl.[3] ..... B22D 5/04

[52] U.S. Cl. ..... 164/329; 198/472

[58] Field of Search ..... 164/324, 325, 329, 331; 198/346, 347, 432, 472, 645, 793, 796, 817

[56] References Cited

U.S. PATENT DOCUMENTS

| | | | |
|---|---|---|---|
| 1,033,254 | 7/1912 | Lister . | |
| 1,319,673 | 10/1919 | Stephenson . | |
| 1,622,875 | 3/1927 | Lee . | |
| 1,635,369 | 7/1927 | Lee . | |
| 3,645,321 | 2/1972 | Robinson | 164/324 |
| 4,150,705 | 4/1979 | Muller | 164/323 |
| 4,186,793 | 2/1980 | Teplinsky et al. | 164/158 |
| 4,200,139 | 4/1980 | Pluim . | |
| 4,299,269 | 11/1981 | Friesen et al. | 164/324 |
| 4,304,288 | 12/1981 | Pluim . | |

FOREIGN PATENT DOCUMENTS

| | | | |
|---|---|---|---|
| 1101630 | 5/1981 | Canada . | |
| 2855128 | 12/1978 | Fed. Rep. of Germany . | |
| 2617255 | 3/1980 | Fed. Rep. of Germany . | |
| 5038621 | 12/1972 | Japan | 164/323 |
| 57-159260 | 10/1982 | Japan | 164/323 |
| 759029 | 10/1956 | United Kingdom | 164/323 |
| 2067940 | 8/1981 | United Kingdom . | |
| 753531 | 8/1980 | U.S.S.R. . | |
| 761131 | 9/1980 | U.S.S.R. . | |

*Primary Examiner*—Nicholas P. Godici
*Assistant Examiner*—Maureen Weikert
*Attorney, Agent, or Firm*—David A. Burge

[57] ABSTRACT

A method and apparatus is disclosed to increase the line speed in a permanent mold casting system by eliminating the acceleration and stopping of a shuttle car system to remove mold wagons from the system by means of a continuous chain drive for the system and the use of a single shuttle car in combination with a chain release means eject a mold wagon from the return line to a wagon storage line of the system.

8 Claims, 3 Drawing Figures

PERMANENT MOLD CASTING SYSTEMS

FIELD OF THE INVENTION

This invention relates to permanent mold casting systems and in particular to means for transferring a mold wagon from one line to another line within such a system.

BACKGROUND OF THE INVENTION

The present invention relates to improvements in permanent mold casting systems of the type shown in our issued Canadian Pat. No. 1,092,782 and our U.S. Pat. No. 4,304,288 of Dec. 8, 1981. In the above-mentioned patents, a linear, permanent mold casting system is disclosed in which parallel operating and return lines or tracks are utilized for movably supporting mold wagons or carriers. Shuttle cars are used to transfer each of the mold wagons or carriers to one end of the return line or track from the operating line or track and for subsequently transferring each of the mold carriers from the terminal end of the return line or track to the start of the operating line or track.

SUMMARY OF THE INVENTION

The improvements to the known system in accordance with the present invention eliminate the two shuttle cars by connecting the operating and return lines with loops at their ends with a chain drive in the return line extending to both ends of the operating line. This provides a higher speed of operation to the system. In addition, the invention incorporates means for ejecting a mold wagon or carrier from the return line to a third or mold change and repair line or track. A single shuttle car is used operating in a direction transverse to the return line. The mold wagon or carrier to be ejected is disengaged from the drive chain, quickly shunted over to the mold change and repair track, and the shuttle car is reciprocated to its original position. With the supporting rails back into this position, the return line rails are again complete which allows the mold carriers to advance along the chain drive system. Due to an increase in speed of operation that results through use of the present invention, the complete system's capacity can be extended to handle an increased number of mold carriers.

According to a broad aspect, the invention relates to a permanent mold casting system having parallel operating and return rail lines that are connected at their ends by return loops, and a plurality of mold carriers are positioned on these lines. A drive chain is provided for driving the carriers from the end of the operating line and along the return line to the start of the operating line. A mold change and repair track is positioned adjacent to the return line with means for laterally ejecting a mold carrier from the return line onto the change and repair track.

A carrier ejecting means is provided for causing disengagement of a selected one the carriers from the drive chain. A shuttle car is provided for supporting the disengaged carrier and a section of the return line on which the disengaged is supported carrier. An actuating means such as an hydraulic or pneumatic ram is utilized for moving the disengaged carrier and the return line section from the remainder of the return line transversely to the change track and back again.

BRIEF DESCRIPTION OF THE DRAWINGS

The invention is illustrated by way of example in the accompanying drawings in which.

DESCRIPTION OF THE PREFERRED EMBODIMENT

Figure 1:
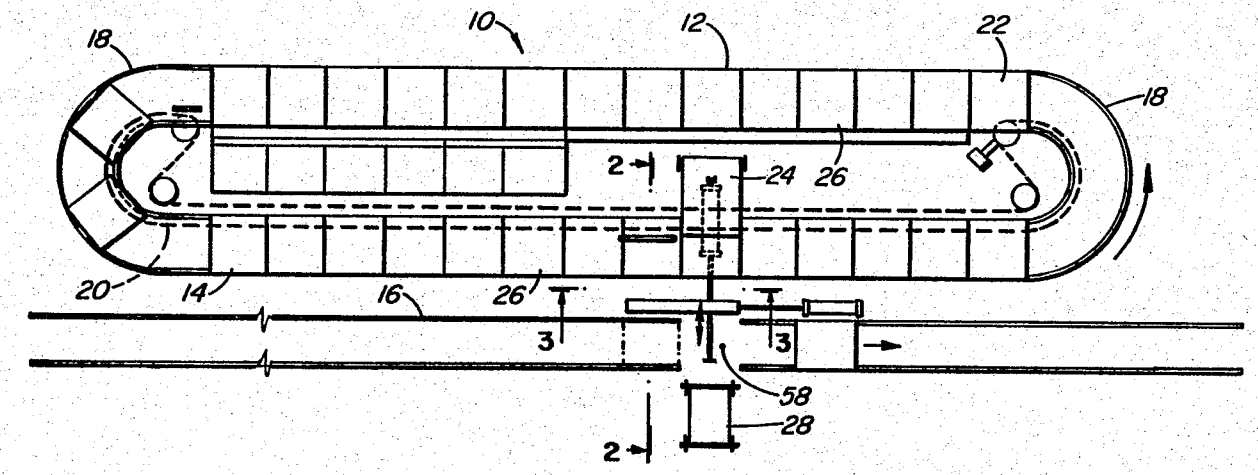
FIG. 1 is a plan view of a mold casting system according to the invention.

Referring to FIG. 1, a permanent mold casting system is indicated generally by the numeral 10. The system 10 has an operating line 12, a return line 14, and a third line 16 that is used for mold changing and mold carrier repair. The operating and return lines 12 and 14 are connected at their ends by semi-circular return loops 18. Mold wagons or carriers 26 are supported on the lines 12 and 14, and are movable therealong and around the loops 18. The carriers 26 are picked up at the end of the operating line 12 (to the left in FIG. 1) by a traveling drive chain 20 and are carried around one of the loops 18 to the return line 14 and subsequently around the other of the loops 18 to a pre-load position 22 at the start of the operating line.

A shuttle car 24 is provided for ejecting a selected one of the mold carriers 26 from the return line 14 onto the third track 16. A section 58 is missing from the track 16. A manually operated car 28 is provided for placement in the open section 58 of the track 16 to receive one of the mold carriers as it is being transferred by the shuttle car 24. Once a carrier has been moved off of the return track 14 it can be moved along the repair track 16 to a position shown in FIG. 1 so that the open space 58 on the repair track 16 is left for a second carrier to be ejected from the return line 14.

Figure 2:
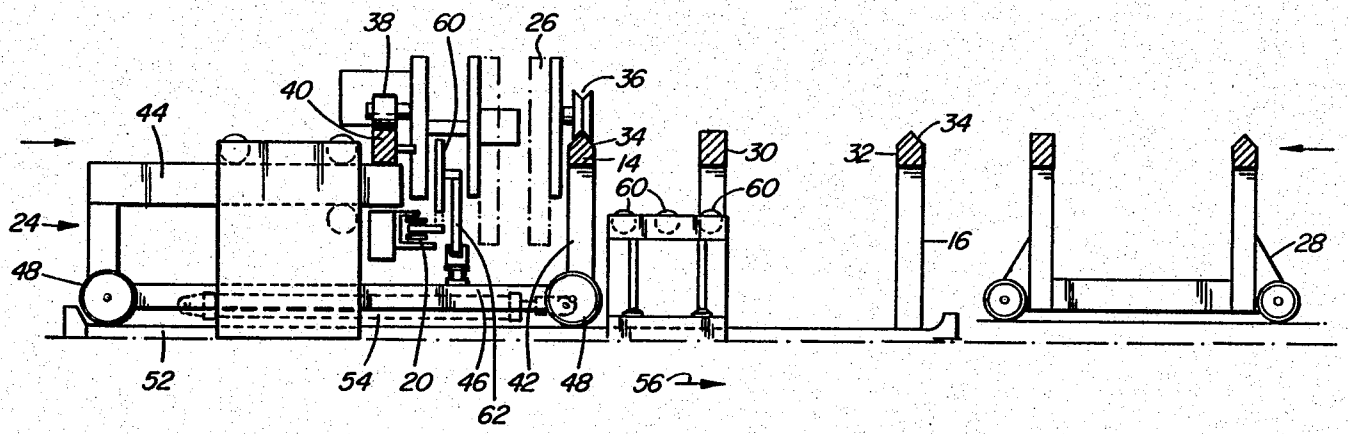
FIG. 2 is a sectional view as seen from a plane indicated by a line 2—2 in FIG. 1.
Figure 3:
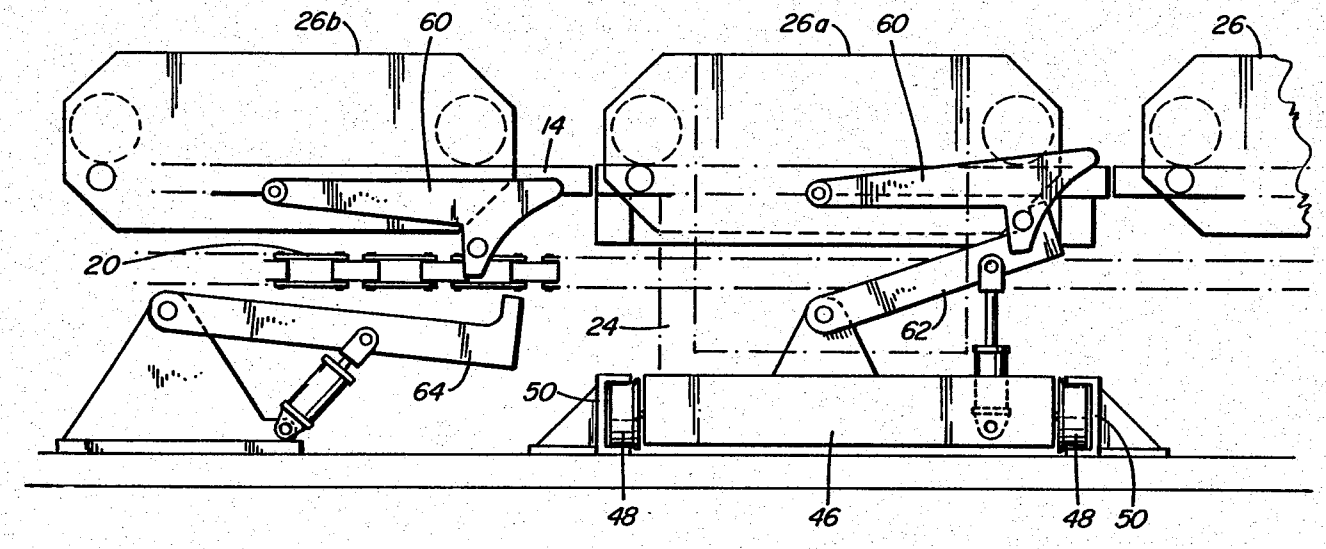
FIG. 3 is an elevational view as seen from a plane indicated by a line 3—3 in FIG. 1.

Referring to FIGS. 2 and 3, it will be seen that the return line 14 and the repair track 16 includes a rail of rectangular cross section 30 and a second rail 32 having a tapered upper edge 34. A grooved wheel 36 is provided on the carrier 26 for engaging the tapered upper edge 34. A wheel having a cylindrical surface 38 is provided on the carrier 26 for running on the rectangular rail 20.

Referring to FIG. 2, a section 40 of the track 14 is carried by the shuttle car 24. The track section 40 is disconnected from the remainder of the track 14. The rail 34 is carried by a pair of vertically oriented frame members 42. The rectangular rail is carried by a cantilever member 44 of the shuttle car 24. The shuttle car 24 also includes a horizontal base or frame member 46 having wheels 48 that run in channels 50.

Referring again to FIG. 2, a large hydraulic or pneumatic ram 54 is connected at one end to the bed portion of the frame 46 and at its other end to a stationary member 52 of the shuttle car 24. When the ram 54 is actuated the shuttle car 24 is moved transversely of the return track 14 in the direction of the arrow 56 whereby the mold carrier 26 and the rail sections 40 move to occupy the open space 58, in the repair track 16. In that position, the upper cantilever 44 of the shuttle car frame is supported by rollers 60 which are positioned intermediate the lines or tracks 14 and 16.

Referring to FIG. 3, each mold carrier 26 is provided with a latch arm 60 for engaging the drive chain 20. When a carrier to be ejected, as designated by the number 26*a* in FIG. 3, reaches a position overlying the shuttle car 24, its latch arm 60 is disengaged from the drive chain 20 by means of a latch lift mechanism 62. A second lift mechanism 64 simultaneously releases the following carrier 26*b* from the chain 20 to provide a gap in the return line to provide time enough for the shuttle car 24 to transfer the mold carrier 26*a* to the track 16. After the shuttle car 24 returns to the position shown in FIG. 2, the latch arm lift mechanism 64 is disengaged allowing the latch arm 60 of the carrier 26*b* to engage the chain 20 whereby the carrier 26*b* can continue in a normal manner.

If two carriers are to be removed from the return line 14 and placed onto the change and repair track 16, the manually operated rail car 28 is moved into the gap 58 in the track 16 to receive the first mold carrier 26*a* from the shuttle car 24. Subsequently, the manually operated car 28 is removed from the repair track to a position as shown in FIG. 2, and the second mold carrier 26*b* is ejected from the return line 14 into the gap 58 of the repair track 16.

It will be appreciated that the system according to the present invention eliminates the use of shuttle cars at either end of the operating and return tracks 12 and 14, and allows a higher speed operation than normal, particularly when a follower type pouring system is used. The ejection of mold carriers from the return line is a rapid form of transferring a mold carrier from one track to another without the necessity of providing switches or turntables to carry out the same function.

While the invention has been described in connection with the specific embodiment thereof and in a specific use, various modifications will occur to those skilled in the art without departing from the spirit and scope of the invention as set forth in the appended claims.

The terms and expressions which have been employed in this disclosure are used as terms of description and not of limitation. There is no intention in the use of such terms and expressions to exclude any equivalents of the features shown and described or portions thereof. It is recognized that various modifications are possible within the scope of the invention as claimed.

The embodiments of the invention in which an exclusive property or privilege is claimed are defined as follows:

1. A permanent mold casting system comprising parallel operating and return rail lines connected at their ends by return loops and having a plurality of mold carriers on said lines; a drive chain for driving said carriers from the end of the operating line and along the return line to the start of the operating line; a mold change and repair track adjacent said return line, and carrier ejecting means for laterally ejecting a mold carrier from the return line onto said change and repair track, and the carrier ejecting means comprises;

(a) means for disengaging a carrier to be ejected from the drive chain;

(b) a shuttle car for supporting said carrier and a section of the return line rails on which said carrier runs; and, (c) actuating means for moving said carrier and rail sections from the return line to said change track.

2. A permanent mold casting system comprising parallel operating and return rail lines, with each of the operating and return lines having opposed ends, and with return loops being provided for connecting each of the ends of the operating line to a separate one of the ends of the return line; a plurality of mold carriers supported on the operating and return lines for movement therealong; drive chain means for extending along at least portions of said return line and for engaging said mold carriers for moving said mold carriers from the end of the operating line, along the return line, and back to the start of the operating line; a mold change and repair track that extends adjacent at least said portion of said return line, and ejection means for laterally ejecting a mold carrier from the return line onto said change and repair track, said ejection means including:

(a) means for disengaging a selected one of the carriers from the drive chain;

(b) shuttle car means for supporting said selected carrier and a section of the return rail line on which said selected carrier is supported; and, (c) actuating means for removing said carrier and said return line section from other sections of the return line to said change and repair track.

3. The system according to claim 2 wherein said shuttle car comprises a cantilever frame having spaced horizontal members in planes above and below said drive chain allowing reciprocal movement of the shuttle car in a transverse direction to said drive chain and return line.

4. The system according to claim 3 including support rollers located intermediate the return and change rails for supporting the cantilever member of the shuttle car in its carrier ejecting position.

5. The system according to claim 4 including a manually operated car provided adjacent said change track and located in alignment with said shuttle car, said manually operated car being adapted to receive the mold carrier ejected from said return line by the shuttle car.

6. The system according to claim 2 wherein said shuttle car means comprises cantilever frame means having spaced horizontal members that extend in planes above and below at least selected portions of said drive chain for allowing reciprocal movement of the shuttle car in a transverse direction relative to said selected portions of said drive chain means and said return line.

7. The system according to claim 6 including support roller means located intermediate the return line and said repair and change track for supporting the cantilever frame means of the shuttle car in a carrier ejecting position.

8. The system according to claim 7 including a manually operated car provided adjacent said change track and located in alignment with said shuttle car, said manually operated car being adapted to receive a chosen mold carrier that has been ejected from said return line by the shuttle car.

* * * * *